US011708967B2

(12) United States Patent
Zhan et al.

(10) Patent No.: US 11,708,967 B2
(45) Date of Patent: Jul. 25, 2023

(54) LUMINAIRE AND LIGHT SOURCE MODULE THEREOF

(71) Applicants: OPPLE LIGHTING CO., LTD., Shanghai (CN); SUZHOU OPPLE LIGHTING CO., LTD., Suzhou (CN)

(72) Inventors: Yong Zhan, Suzhou (CN); Xianglan Li, Suzhou (CN); Liuhua Xiao, Suzhou (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/566,561

(22) Filed: Dec. 30, 2021

(65) Prior Publication Data

US 2022/0120428 A1 Apr. 21, 2022

Related U.S. Application Data

(63) Continuation of application No. PCT/CN2020/111579, filed on Aug. 27, 2020.

(30) Foreign Application Priority Data

Sep. 29, 2019 (CN) ..... 201910934668.6
Sep. 29, 2019 (CN) ..... 201921643827.9

(51) Int. Cl.
*F21V 29/70* (2015.01)
*F21V 19/00* (2006.01)

(52) U.S. Cl.
CPC ..... *F21V 29/70* (2015.01); *F21V 19/003* (2013.01)

(58) Field of Classification Search
CPC ..... F21V 19/003; F21K 9/68; F21Y 2107/30
See application file for complete search history.

(56) References Cited

U.S. PATENT DOCUMENTS

2011/0170299 A1* 7/2011 Takase ..... F21V 5/04 362/308
2017/0211750 A1* 7/2017 Yotsumoto ..... F21V 33/0056

FOREIGN PATENT DOCUMENTS

CN 207674137 U 7/2018
CN 108826034 A 11/2018
CN 108870111 A 11/2018
CN 110553227 A 12/2019
(Continued)

OTHER PUBLICATIONS

International Search Report of PCT Application No. PCT/CN2020/111579 dated Dec. 2, 2020 with English translation, (4p).

*Primary Examiner* — Karabi Guharay
(74) *Attorney, Agent, or Firm* — Arch & Lake LLP

(57) ABSTRACT

The disclosure discloses a light source module of a luminaire including a light source board, a heat dissipating component, a first sleeving component, and a second sleeving component, wherein the heat dissipating component includes a mounting base portion; the second sleeving component is sleeved on the first sleeving component and presses the light source board on the mounting base portion; the light source board includes illuminators; the first sleeving component has an avoidance space, and the illuminators are located in the avoidance space; and at least a region, opposing to the illuminators, of the second sleeving component is a light transmission region.

16 Claims, 4 Drawing Sheets

(56) References Cited

FOREIGN PATENT DOCUMENTS

| | | | |
|---|---|---|---|
| CN | 210267118 | U | 4/2020 |
| KR | 20170031374 | A | 3/2017 |

* cited by examiner

LUMINAIRE AND LIGHT SOURCE MODULE THEREOF

CROSS-REFERENCE TO RELATED APPLICATIONS

The present application is a continuation of PCT patent application No. PCT/CN2020/111579 filed on Aug. 27, 2020 which is based upon and claims the priority of Chinese patent application No. 201910934668.6 filed on Sep. 29, 2019 and Chinese patent application No. 201921643827.9 filed on Sep. 29, 2019, the entire contents of which are incorporated herein by reference for all purposes.

TECHNICAL FIELD

The present disclosure relates to the technical field of luminaire, and in particular, to a luminaire and a light source module thereof.

BACKGROUND

With rising demand among users and the development of technology, luminaires show increasingly improved performance, and various light source boards are widely used in a variety of luminaires accordingly. Among these light source boards, flexible light source boards have good deformability and thus can be easily designed into a wide range of shapes. Therefore, the flexible light source boards have been increasingly favored by manufacturers.

Existing flexible light source boards are usually fixed by way of sticking with an adhesive. Such a fixation manner is susceptible to the adhesive. In the actual operating process, an adhesive is liable to failure because of environmental factors such as temperature and humidity and thus causes a flexible light source board to separate, which will eventually lead to poor structural stability of a luminaire.

SUMMARY

The disclosure discloses a luminaire and a light source module thereof for solving the problem of bad structural stability in the current luminaires.

For solving the above problem, the disclosure adopts the following technical solutions.

A light source module of a luminaire includes a light source board, a heat dissipating component, a first sleeving component, and a second sleeving component. The heat dissipating component comprises a mounting base portion; the second sleeving component is sleeved on the first sleeving component and presses the light source board on the mounting base portion; the light source board comprises illuminators; the first sleeving component has an avoidance space, and the illuminators are located in the avoidance space; and at least a region, opposing to the illuminators, of the second sleeving component is a light transmission region.

A luminaire comprises the above mentioned light source module.

BRIEF DESCRIPTION OF THE DRAWINGS

The accompanying drawings illustrated herein are provided for further understanding of the present disclosure, and constitute a part of the present disclosure. The exemplary embodiments and descriptions of the present disclosure are intended to explain the disclosure, but do not constitute inappropriate limitations to the disclosure. In the drawings.

DETAILED DESCRIPTION

Figure 1:
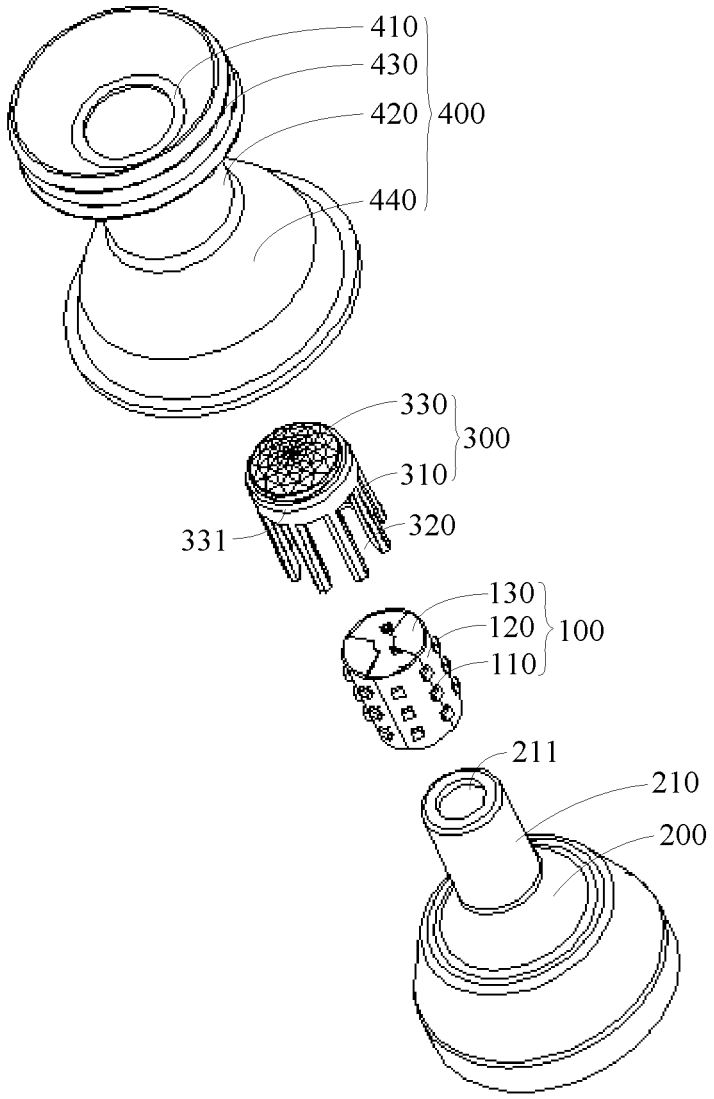
FIG. 1 is an exploded structure diagram of a light source module disclosed in an embodiment of the present disclosure.

In order to make the object, technical scheme and advantages of the present disclosure clearer, the technical scheme of the present disclosure will be clearly and completely described below with reference to specific embodiments of the present disclosure and the corresponding drawings. Obviously, the described embodiments are only part of the embodiments of the present disclosure, not all embodiments of the present disclosure. Based on the embodiments in the present disclosure, all other embodiments obtained by those skilled in the art without creative work are within the scope of the present disclosure.

Following is a list of reference numerals in the drawings: 100—light source board, 110—illuminator, 120—tubular flexible circuit board, 130—electrical connection portion, 200—heat dissipating component, 210—mounting base portion, 211—first port, 300—first sleeving component, 310—elastic pressing strip, 320—avoidance gap, 330—end cap, 331—limiting recess, 400—second sleeving component, 410—limiting protrusion, 420—sleeving light—guide portion, 430—first light distribution portion, 431—first conical surface, 432—second conical surface, 433—first junction surface, 434—second junction surface, 440—second light distribution portion, 500—electrical connection and mounting head, 600—lamp, 700—shade, A—inner cavity, B—lamp cavity.

The technical solutions disclosed in different embodiments of the present disclosure are described in details below with reference to the accompanying drawings.

Referring to FIG. 1 to FIG. 6, an embodiment of the present disclosure discloses a light source module of a luminaire. The disclosed light source module includes a light source board 100, a heat dissipating component 200, a first sleeving component 300 and a second sleeving component 400.

The heat dissipating component 200 is a basic component of the light source module. The heat dissipating component 200 can not only serve for heat dissipation for the entire light source module, but also provide an installation base for other components of the light source module. For the sake of better heat dissipation, the heat dissipating component 200 is typically a structural metal component with excellent heat dissipation performance, such as an iron component and an aluminum component. Of course, the structural metal component has high strength, which is conducive to providing better support for other components of the light source module. In the embodiment of the present disclosure, the heat dissipating component 200 includes a mounting base portion 210.

The light source board 100 is a light emitting assembly of the light source module. The light source board 100 includes illuminators 110. Typically, the illuminator 110 may preferably be a light-emitting diode (LED) illuminator which has the advantages of environmental friendliness, energy conservation, long service life, etc.

The second sleeving component 400 is sleeved on the first sleeving component 300 and presses the light source board 100 on the mounting base portion 210. That is to say, the second sleeving component 400 presses the light source board 100 on the mounting base portion 210 through the first sleeving component 300, and the light source board 100 is clamped between the first sleeving component 300 and the mounting base portion 210.

In the embodiment of the present disclosure, the first sleeving component 300 has an avoidance space, and the illuminators 110 are located in the avoidance space. At least a region, opposing the illuminators 110, of the second sleeving component 400 is a light transmission region. In other words, partial region of the first sleeving component 300 is kept away from the illuminators 110, thus avoiding exerting pressure on the illuminators 110. In the actual operating process, the light emitted by the illuminators 110 exits through the light transmission region, thereby achieving light emission from the light source module.

Specifically, the avoidance space may have various structures. For example, the avoidance space may be an avoidance hole formed in the first sleeving component 300. In one particular implementation, the first sleeving component 300 may be a tubular sleeve having an avoidance hole formed in the sidewall thereof.

In the light source module of a luminaire disclosed in the embodiment of the present disclosure, the light source board 100 is clamped between the first sleeving component 300 and the heat dissipating component 200 by the second sleeving component 400 that is sleeved on the first sleeving component 300, so that the light source board 100 is eventually fixed. The illuminators 110 of the light source board 100 are located in the avoidance space of the first sleeving component 300 and can emit light that exits through the light transmission region of the second sleeving component 400. Thus, the illuminators 110 would not be affected as being pressed by the first sleeving component 300, and normal light emission of the light source module can be ensured. Compared with the assembling of light source board 100 by sticking in the prior art, the fixation manner of the light source board 100 herein can provide better fixation undoubtedly, allowing for improved structural stability of the luminaire.

In the embodiment of the present disclosure, the light source board 100 may be a rigid light source board and may also be a flexible light source board. Due to good deformability, the flexible light source board can be easily designed into a wide range of shapes. Based on this, in a preferred solution, the light source board 100 is the flexible light source board.

The flexible light source board may have various structures. Referring back to FIG. 1, the flexible light source board in one particular implementation may include a tubular flexible circuit board 120 and illuminators 110 disposed on the outer side surface of the tubular flexible circuit board 120. The tubular flexible circuit board 120 is sleeved on the mounting base portion 210. The first sleeving component 300 presses the tubular flexible circuit board 120 on the mounting base portion 210. In the specific assembling process, the tubular flexible circuit board 120 is firstly sleeved on the mounting base portion 210 for pre-mounting, and then the first sleeving component 300 and the second sleeving component 400 are mounted in sequence. Finally, the second sleeving component 400 presses the tubular flexible circuit board 120 on the mounting base portion 210 through the first sleeving component 300, thereby eventually resulting in fixation of the entire light source board 100.

Meanwhile, the use of sleeving of the tubular flexible circuit board 120 is beneficial to provide more mounting positions for the illuminators 110, facilitating light emission from the light source board 100 in multiple directions.

The illuminators 110 may be disposed on the tubular flexible circuit board 120 in a variety of distribution ways. In a preferred solution, the illuminators 110 may be disposed on the outer side surface of the tubular flexible circuit board 120 in rows, and each row of the illuminators 110 may be dispersedly arranged along the corresponding avoidance space, thus allowing for multi-point light emission. Specifically, the illuminators 110 may be distributed in a plurality of rows. The plurality of rows of illuminators 110 are distributed at intervals in the circumferential direction of the tubular flexible circuit board 120, thus allowing the light source module to emit light in multiple directions.

For the convenience of supplying power to the light source board 100, in a preferred solution, the heat dissipating component 200 may be a hollow structural component which is light in weight and thus is beneficial to weight reduction of the entire light source module. On the basis of the heat dissipating component 200 being the hollow structural component, the mounting base portion 210 may have a first port 211 in communication with inner cavity A of the heat dissipating component 200. The light source module may also include a power supply assembly configured to supply power to the operation of the light source board 100. specifically, the power supply assembly may be in power supply connection with the tubular flexible circuit board 120 through the first port 211. At least a part of the power supply assembly is located in the inner cavity A. Such a structural configuration in which the power supply assembly is built in the heat dissipating component 200 can make full use of the space of the inner cavity A of the heat dissipating component 200, allowing for more compact structure of the entire light source module and also for heat dissipation of the power supply assembly through the heat dissipating component 200.

For the convenience of connection, the light source board 100 may also include an electrical connection portion 130. The electrical connection portion 130 is located in a position opposite to the first port 211. The electrical connection portion 130 electrically connects the tubular flexible circuit board 120 with the power supply assembly. Specifically, the electrical connection portion 130 may be an electrical connector and may also be an ordinary wire. In a preferred solution, the electrical connection portion 130 may be a flexible circuit board integrated with the tubular flexible circuit board 120. Such a structure is convenient to be manufactured and can enable simplified assembling. During assembling, an operator may bend, relative to the tubular flexible circuit board 120, the electrical connection portion 130 to the position opposite to the first port 211.

Typically, the power supply assembly may include a driver which may be disposed in the inner cavity A. As shown in FIG. 1, the mounting base portion 210 may be a hollow shaft, and the internal space of the hollow shaft is part of the inner cavity A of the heat dissipating component 200.

In the embodiment of the present disclosure, the first sleeving component 300 and the second sleeving component 400 may have various structures. Referring to FIG. 3 again, in one particular implementation, the first sleeving component 300 may include at least two elastic pressing strips 310 distributed around the mounting base portion 210. An avoidance gap 320 is formed between two adjacent elastic pressing strips 310. The avoidance gap 320 is the avoidance space described above. With the avoidance gap 320 formed between two adjacent elastic pressing strips 310 as the avoidance space, it can be better to be kept away from the illuminators 110 and also help regular arrangement of the illuminators 110.

Provided that the first sleeving component 300 includes at least two elastic pressing strips 310, the elastic pressing strips 310 may be directly connected to one another. Of course, for the sake of more stable assembling of the first sleeving component 300 and higher strength of the first sleeving component 300, the first sleeving component 300 may further include an end cap 330 in a preferred solution, where one end of each elastic pressing strip 310 is connected to the edge of the end cap 330, while the other end thereof is a free end. Of course, in this case, due to the cantilever structure of the elastic pressing strip 310, the first sleeving component 300 and the light source board 100 may be disassembled more easily after the removal of the second sleeving component 400.

For the convenience of manufacturing, in a preferred solution, the first sleeving component 300 may be an integrated injection-molded structural component. That is to say, the end cap 330 and the elastic pressing strips 310 are injection-molded components and connected by means of injection molding.

Figure 2:
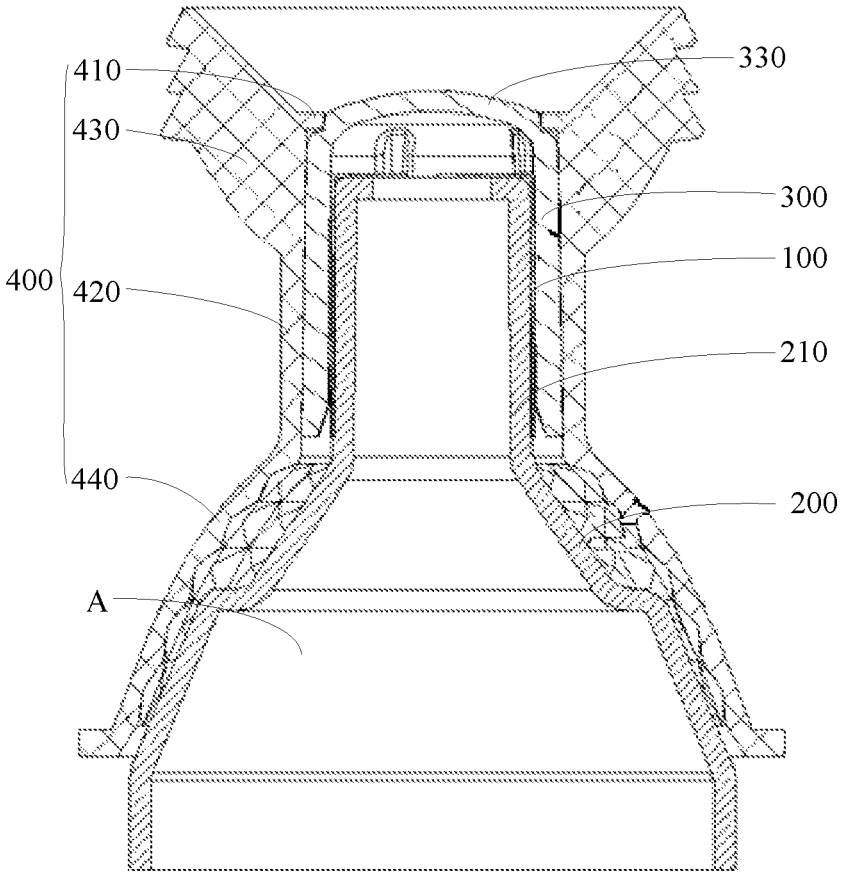
FIG. 2 is a sectional view of a light source module disclosed in an embodiment of the present disclosure.
Figure 3:
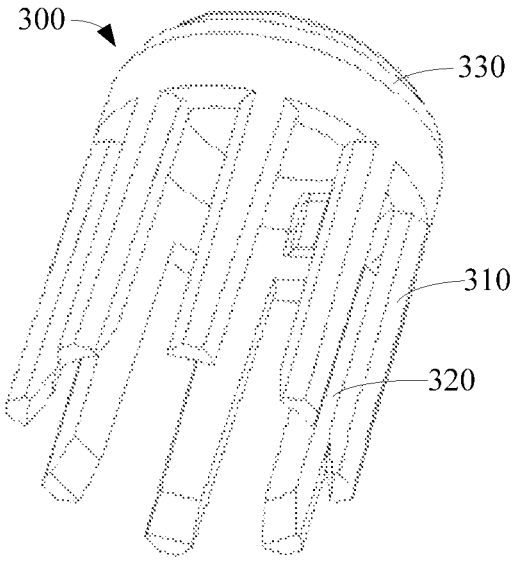
FIG. 3 is a structure diagram of a first sleeving component disclosed in an embodiment of the present disclosure.

In a preferred solution, the end cap 330 may have a limiting recess 331 at the edge of the surface thereof away from the elastic pressing strips 310, while the second sleeving component 400 has a limiting protrusion 410 on the inner wall thereof. As shown in FIG. 2, the limiting protrusion 410 limitedly fits with the limiting recess 331. Upon the second sleeving component 400 being sleeved on the first sleeving component 300, the limiting protrusion 410 may limitedly fit with the limiting recess 311 such that the second sleeving component 400 can be prevented from moving unduly on the first sleeving component 300, thereby ensuring the assembling positions of the second sleeving component 400 and the first sleeving component 300 relative to each other. In the actual assembling process, an operator may align one open end of the second sleeving component 400 to one end of the first sleeving component 300 and then push the second sleeving component 400 onto the first sleeving component 300. When the second sleeving component 400 cannot move continuously relative to the first sleeving component 300, it indicates that the limiting protrusion 410 is already in fit with the limiting recess 311, i.e., the assembling of the second sleeving component 400 with the first sleeving component 300 is already completed.

In the embodiment of the present disclosure, the first sleeving component 300 serves as not only a fastener for fixing the light source board 100, but also a sleeving light-guide component. The surface, away from the elastic pressing strips 310, of the end cap 330 may be a light distribution surface. In this case, during the operation of the light source module, the light emitted by the illuminators 110 may be guided into the end cap 330 through the elastic pressing strips 310 and finally distributed through the light distribution surface of the end cap 330, rendering a preset light emitting effect. Specifically, the light distribution surface may be a scattering surface.

For the sake of better fixation of the light source board 100, in a preferred solution, the number of the elastic pressing strips 310 is at least three, thus allowing for pressing action in more positions. Specifically, the spacing between any two adjacent elastic pressing strips 310 is identical and forms the avoidance gap 320. In this case, it is certain that the first sleeving component 300 can achieve more balanced pressing fixation of the light source board 100.

For the purpose of fixing the light source board 100 more securely, in a preferred solution, the second sleeving component 400 may be in interference fit with the first sleeving component 300.

In the embodiment of the present disclosure, to improve the light emitting effect of the light source module, the second sleeving component 400 may be a light distribution element in a preferred solution. In this case, after being incident onto the second sleeving component 400, the light emitted by the illuminators can be distributed by the second sleeving component 400 to achieve a preset light distribution effect.

Figure 4:
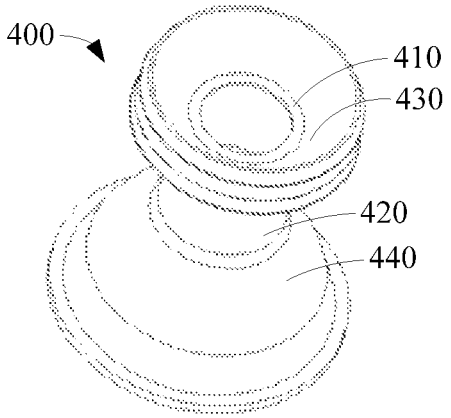
FIG. 4 is a structure diagram of a second sleeving component disclosed in an embodiment of the present disclosure.
Figure 5:
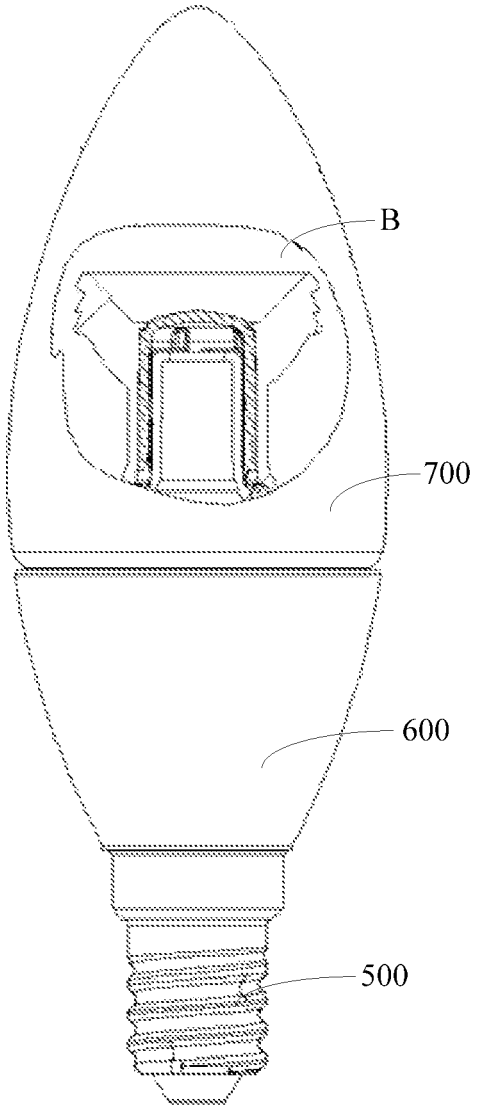
FIG. 5 is a structure diagram of a luminaire disclosed in an embodiment of the present disclosure.

Specifically, the second sleeving component 400 may have various structures. Referring to FIG. 2, FIG. 4 and FIG. 6 again, in a preferred solution, the second sleeving component 400 may include a sleeving light-guide portion 420, and a first light distribution portion 430 and a second light distribution portion 440 that are connected to the sleeving light-guide portion 420, respectively. The sleeving light-guide portion 420 is sleeved on the first sleeving component 300. The sleeving light-guide portion 420 is capable of receiving light emitted by the illuminators 110 and guiding the light to the first light distribution portion 430 and the second light distribution portion 440, thereby realizing light distribution by the first light distribution portion 430 and the second light distribution portion 440. Specifically, the sleeving light-guide portion 420 may be in interference fit with the first sleeving component 300, thus allowing the first sleeving component 300 to better press the light source board 100.

The limiting protrusion 410 described above may be disposed on the sleeving light-guide portion 420. Specifically, the limiting protrusion 410 may be disposed at the edge of a port of the sleeving light-guide portion 420. For the sake of better limiting of position, in a preferred solution, the limiting protrusion 410 may be an annular limiting protrusion at the edge of the port of the sleeving light-guide portion 420. Apparently, the annular limiting protrusion can achieve an omni-directional limiting effect.

Figure 6:
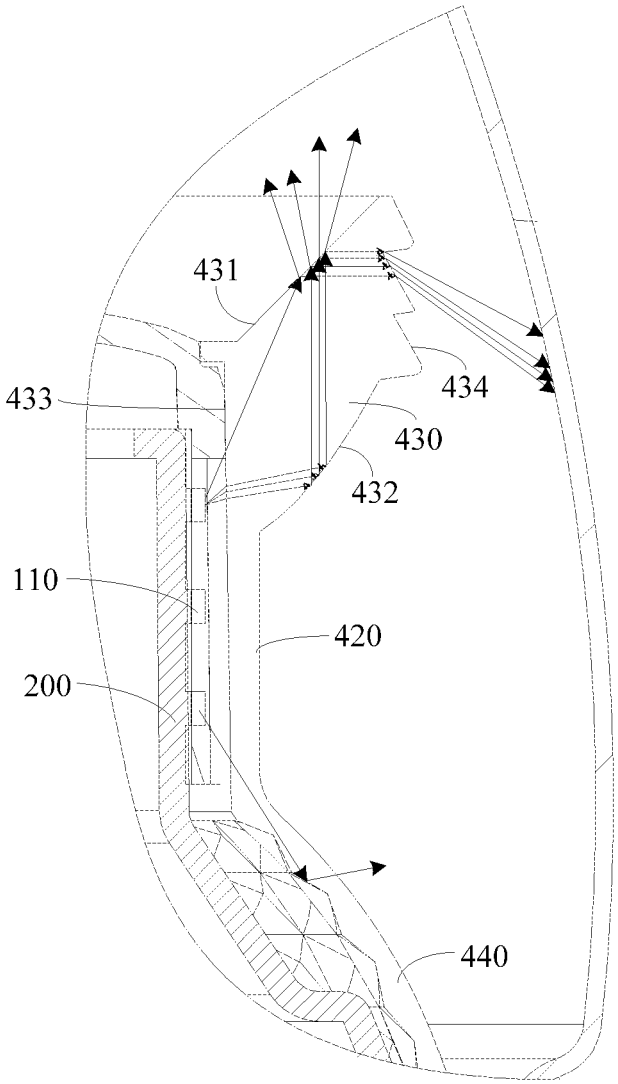
FIG. 6 is an optical partial structure diagram of a luminaire disclosed in an embodiment of the present disclosure.

As shown in FIG. 6, specifically, the first light distribution portion 430 may include a first conical surface 431, a second conical surface 432, a first junction surface 433, and a second junction surface 434. The first junction surface 433 is coplanar with an inner wall surface of the sleeving light-guide portion 420. Two ends of the first junction surface 433 are joined to a first end of the first conical surface 431 and a first end of the second conical surface 432, respectively. The second conical surface 432 is joined to an outer wall surface of the sleeving light-guide portion 420. Two ends of the second junction surface 434 are joined to a second end of the first conical surface 431 and a second end of the second conical surface 432, respectively.

Specifically, the second junction surface 434 may be a serrated surface, so that an angle of the outgoing light from the second junction surface 434 can be adjusted. The second conical surface 432 may be a full reflection surface, and the first conical surface 431 may be a transflective surface.

Referring to FIG. 6, in the actual light distribution process, the light emitted by the illuminators 110 is transmitted by the sleeving light-guide portion 420 or directly projected onto the first light distribution portion 430. In this process, the light incident on the second conical surface 432 will be fully reflected to the first conical surface 431. Certainly, some of light can be incident onto the first conical surface 431 directly rather than reflected by the second conical surface 432. Since the first conical surface 431 is the transflective surface, one part of light will be reflected by the first conical surface 431 and finally thrown out by the second junction surface 434, while the other part of light that is projected onto the first conical surface 431 will exit through the first conical surface 431.

The outer side surface of the second light distribution portion 440 may be a scattering surface. The light projected by the illuminators 110 to the second light distribution portion 440 will be scattered through the outer side surface of the second light distribution portion 440, thereby resulting in formation of a uniform light-emitting zone. Specifically, the outer side surface of the second light distribution portion 440 may have a scattering microstructure, such as a scattering protrusion.

In a more preferred solution, the inner side surface of the second light distribution portion 440 may be a micro-structured prismatic surface. The second light distribution portion 440 is sleeved on part of the heat dissipating component 200 to shield this part of the heat dissipating component 200 from being exposed by the second light distribution portion 440. The micro-structured prismatic surface as the inner side surface of the second light distribution portion 440 can enable a person to experience a similar visual feeling to crystal when viewing it while preventing the person from seeing the heat dissipating component 200 through the second light distribution portion 440. Those skilled in the art can use well-known optical design means to adjust the parameters of the micro-structured prismatic surface, such as inclination angle and shape, to achieve the above-mentioned light distribution effect, which will not be redundantly described here. Specifically, the inner side surface of the second light distribution portion 440 may be micro-structured to form the micro-structured prismatic surface, for example, in such a manner being composed of a plurality of pyramids.

For the convenience of manufacturing, in a preferred solution, the second sleeving component 400 may be an integrated structural component. Specifically, the second sleeving component 400 may be the integrated structural component made of transparent material. For example, the second sleeving component 400 may be a structural component made of glass or a polymer.

To improve the light distribution effect, in a preferred solution, the second sleeving component 400 may be a revolving body, thereby allowing for balanced light distribution in multiple directions and also facilitating manufacturing.

An embodiment of the present disclosure discloses a luminaire based on the light source module disclosed in the foregoing embodiment of the present disclosure. The disclosed luminaire includes the light source module described in the foregoing embodiment.

Referring to FIG. 5 again, the luminaire disclosed in the embodiment of the present disclosure may include an electrical connection and mounting head 500, a lamp 600 and a shade 700. The electrical connection and mounting head 500 is a component for achieving the installation and electrical connection of the entire luminaire. The lamp 600 is the main body of the luminaire and also provides an installation base for other parts of the luminaire. The shade 700 is fixed to the lamp 600. The shade 700 and the lamp 600 are combined to form a lamp cavity B. The electrical connection and mounting head 500 is electrically connected to the lamp 600. The light source module is mounted in the lamp cavity B. The lamp 600 is electrically connected to the light source module. Light produced during the operation of the light source module can be thrown out of the luminaire through the shade 700.

Specifically, the heat dissipating component 200 and the lamp 600 may be connected by a threaded connecting piece (e.g., a screw) or by way of clamping or sticking. The embodiment of the present disclosure has no limitation on the specific connection ways between the heat dissipating component 200 and the lamp 600.

The luminaire disclosed in the embodiment of the present disclosure may be a candle lamp and may also be an ordinary luminaire. The embodiment of the present disclosure has no limitation on the specific types of the luminaire.

The following beneficial effects can be obtained by the technical solutions provided in the disclosure.

In the light source module of a luminaire disclosed in the embodiment of the present disclosure, the light source board is clamped between the first sleeving component and the heat dissipating component by the second sleeving component that is sleeved on the first sleeving component, so that the light source board is eventually fixed. The illuminators of the light source board are located in the avoidance space of the first sleeving component and can emit light that exits through the light transmission region of the second sleeving component. Thus, the illuminators would not be affected as being pressed by the first sleeving component, and normal light emission of the light source module can be ensured. Compared with the assembling of light source board by sticking in the prior art, the fixation manner of the light source board herein can provide better fixation undoubtedly, allowing for improved structural stability of the luminaire.

The present disclosure may include dedicated hardware implementations such as disclosure specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Those skilled in the art will easily conceive of other examples of the present disclosure after considering the specification and practicing the present disclosure disclosed herein. The present application is intended to cover any variations, uses, or adaptive changes of the present disclosure. These variations, uses, or adaptive changes follow the general principles of the present disclosure and include common knowledge or conventional technical means in the technical field that are not disclosed in the present disclosure. The description and the examples are to be regarded as exemplary only.

The above embodiments of the present disclosure focus on the differences among various embodiments. As long as there is no contradiction between different optimization features among various embodiments, they can be combined to form better embodiments. Considering the brevity of the description, they will not be repeated here.

The above description is only embodiments of the present disclosure, and is not intended to limit the present disclosure. Various modifications and variations of the present disclosure are possible to those skilled in the art. Any modification, equivalent substitution, improvement, etc. made within the spirit and principle of the present disclosure should be included within the scope of the claims of the present disclosure.

The invention claimed is:

1. A light source module of a luminaire, comprising:

a light source board, a heat dissipating component, a first sleeving component, and a second sleeving component, wherein the heat dissipating component comprises a mounting base portion; the second sleeving component is sleeved on the first sleeving component and presses the light source board on the mounting base portion; the light source board comprises illuminators; the first sleeving component has an avoidance space, and the illuminators are located in the avoidance space; and at least a region, opposing to the illuminators, of the second sleeving component is a light transmission region;

wherein the second sleeving component is a light distribution element;

wherein the second sleeving component comprises a sleeving light-guide portion, and a first light distribution portion and a second light distribution portion that are connected to two ends of the sleeving light-guide portion, respectively; and the sleeving light-guide portion is sleeved on the first sleeving component.

2. The light source module according to claim 1, wherein the light source board is a flexible light source board which comprises a tubular flexible circuit board and the illuminators disposed on an outer side surface of the tubular flexible circuit board; the tubular flexible circuit board is sleeved on the mounting base portion; and the first sleeving component presses the tubular flexible circuit board on the mounting base portion.

3. The light source module according to claim 2, wherein the illuminators are disposed in rows on the outer side surface of the tubular flexible circuit board, and each row of illuminators is dispersedly arranged along the corresponding avoidance space.

4. The light source module according to claim 2, wherein the heat dissipating component is a hollow structural component; the mounting base portion has a first port in communication with an inner cavity of the heat dissipating component; the light source module further comprises a power supply assembly which is in power supply connection with the tubular flexible circuit board through the first port; and at least a part of the power supply assembly is located in the inner cavity.

5. The light source module according to claim 4, wherein the light source board further comprises an electrical connection portion which is located in a position opposite to the first port and electrically connects the tubular flexible circuit board with the power supply assembly.

6. The light source module according to claim 1, wherein the first sleeving component comprises at least two elastic pressing strips distributed around the mounting base portion; an avoidance gap is formed between two adjacent elastic pressing strips; and the avoidance gap is the avoidance space.

7. The light source module according to claim 6, wherein the first sleeving component further comprises an end cap; and each of the elastic pressing strips has one end connected to an edge of the end cap and the other end as a free end.

8. The light source module according to claim 7, wherein the end cap has a limiting recess at an edge of a surface thereof away from the elastic pressing strips, while the second sleeving component has a limiting protrusion on an inner wall thereof; and the limiting protrusion is limitedly fit with the limiting recess.

9. The light source module according to claim 7, wherein the first sleeving component is a sleeving light-guide component; and the surface, away from the elastic pressing strips, of the end cap is a light distribution surface.

10. The light source module according to claim 6, wherein a number of the elastic pressing strips is at least three; a spacing between any two adjacent elastic pressing strips is identical and forms the avoidance gap.

11. The light source module according to claim 1, wherein the sleeving light-guide portion is capable of receiving light emitted by the illuminators and guiding the light to the first light distribution portion and the second light distribution portion.

12. The light source module according to claim 11, wherein the first light distribution portion comprises a first conical surface, a second conical surface, a first junction surface, and a second junction surface; the first junction surface is coplanar with an inner wall surface of the sleeving light-guide portion; two ends of the first junction surface are joined to a first end of the first conical surface and a first end of the second conical surface, respectively; the second conical surface is joined to an outer wall surface of the sleeving light-guide portion; two ends of the second junction surface are joined to a second end of the first conical surface and a second end of the second conical surface, respectively;

the second conical surface is a full reflection surface, the first conical surface is a transflective surface, and the second junction surface is a serrated surface.

13. The light source module according to claim 11, wherein an outer side surface of the second light distribution portion is a scattering surface, while an inner side surface of the second light distribution portion is a micro-structured prismatic surface; and the second light distribution portion is sleeved on a part of the heat dissipating component.

14. The light source module according to claim 1, wherein the second sleeving component is in interference fit with the first sleeving component.

15. A luminaire, comprising the light source module according to claim 1.

16. The luminaire according to claim 15, further comprising an electrical connection and mounting head, a lamp and a shade, wherein the shade is fixed to the lamp; the shade and the lamp are combined to form a lamp cavity; the electrical connection and mounting head is electrically connected to the lamp; the light source module is mounted in the lamp cavity; and the lamp is electrically connected to the light source module.

* * * * *